US010412532B2

(12) United States Patent
Pearson

(10) Patent No.: US 10,412,532 B2
(45) Date of Patent: Sep. 10, 2019

(54) ENVIRONMENT DISCOVERY VIA TIME-SYNCHRONIZED NETWORKED LOUDSPEAKERS

(71) Applicant: Harman International Industries, Incorporated, Stamford, CT (US)

(72) Inventor: Levi Gene Pearson, Lehi, UT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/209,814

(22) Filed: Dec. 4, 2018

(65) Prior Publication Data

US 2019/0110153 A1 Apr. 11, 2019

Related U.S. Application Data

(63) Continuation-in-part of application No. 15/690,322, filed on Aug. 30, 2017.

(51) Int. Cl.
*H04R 3/00* (2006.01)
*H04S 7/00* (2006.01)
(Continued)

(52) U.S. Cl.
CPC ..... *H04S 7/305* (2013.01); *H04R 5/04* (2013.01); *H04R 3/005* (2013.01); *H04R 5/02* (2013.01); *H04R 5/027* (2013.01); *H04R 2201/401* (2013.01); *H04R 2203/12* (2013.01); *H04S 3/008* (2013.01); *H04S 2400/01* (2013.01); *H04S 2400/11* (2013.01)

(58) Field of Classification Search
CPC ..... H04S 7/305; H04S 3/008; H04S 2400/01; H04S 2400/11; H04R 5/02; H04R 5/04; H04R 3/005; H04R 5/027; H04R 2201/401; H04R 2203/12
USPC .. 381/303, 58, 387, 59, 122, 92, 97, 98, 99, 381/182, 56, 89; 73/645
See application file for complete search history.

(56) References Cited

U.S. PATENT DOCUMENTS 5,737,431 A * 4/1998 Brandstein ..... G01V 1/001 348/E7.083
6,826,284 B1 * 11/2004 Benesty ..... G01S 5/22 348/14.08
(Continued)

FOREIGN PATENT DOCUMENTS

EP 2375779 A3 1/2011
EP 2375779 A2 10/2011
(Continued)

*Primary Examiner* — Vivian C Chin
*Assistant Examiner* — Con P Tran
(74) *Attorney, Agent, or Firm* — Angela M. Brunetti

(57) ABSTRACT

A method for creating a model of reflective surfaces in a listening environment that may be applied to noise cancellation for a network of AVB/TSN loudspeaker components. A coordinator determines co-planarity and estimates orientation of all echoes of a stimulus by using recorded precise times of arrival, determined angles of arrival and the known, or estimated, locations of each loudspeaker component. The coordinator groups reflection points into planar regions based on co-planarity and estimated orientations to determine a location of each reflective surface in the listening environment thereby creating a model of all of the reflective surfaces in the listening environment.

12 Claims, 10 Drawing Sheets

(51) Int. Cl.

| | |
|---|---|
| ***H04R 5/04*** | (2006.01) |
| *H04R 5/02* | (2006.01) |
| *H04S 3/00* | (2006.01) |
| *H04R 5/027* | (2006.01) |

(56) References Cited

U.S. PATENT DOCUMENTS

| | | | | |
|---|---|---|---|---|
| 7,039,199 | B2 * | 5/2006 | Rui | H04R 3/005 348/14.08 |
| 7,991,167 | B2 * | 8/2011 | Oxford | H04R 3/005 381/122 |
| 8,144,632 | B1 | 3/2012 | Chapweske et al. | |
| RE47,049 | E * | 9/2018 | Zhu | H04R 3/005 |
| 2005/0254662 | A1 | 11/2005 | Blank et al. | |
| 2011/0002429 | A1 | 1/2011 | Williams et al. | |
| 2012/0327300 | A1 | 12/2012 | Hutchings et al. | |
| 2013/0003757 | A1 | 1/2013 | Boatright et al. | |
| 2013/0117408 | A1 * | 5/2013 | Kniplitsch | H04L 67/322 709/217 |
| 2015/0245306 | A1 * | 8/2015 | Boehlke | H04J 3/0664 370/350 |

FOREIGN PATENT DOCUMENTS

| | | | |
|---|---|---|---|
| EP | 3148224 | A2 | 3/2017 |
| EP | 3148224 | A3 | 6/2017 |

* cited by examiner

ENVIRONMENT DISCOVERY VIA TIME-SYNCHRONIZED NETWORKED LOUDSPEAKERS

CROSS REFERENCE

This application is a Continuation-in-Part of co-pending U.S. application Ser. No. 15/690,322, filed on Aug. 30, 2017.

TECHNICAL FIELD

The inventive subject matter is directed to a system and method for determining a location of surfaces that are reflective to audio waves for a system of networked loudspeakers.

BACKGROUND

Sophisticated three-dimensional audio effects, such as those used in virtual and/or augmented reality (VR/AR) systems, require a detailed representation of an environment in which loudspeakers reside in order to generate a correct transfer function used by effect algorithms in the VR/AR systems. Also, reproducing the three-dimensional audio effects typically requires knowing, fairly precisely, the relative location and orientation of loudspeakers being used. Currently, known methods require manual effort to plot a number of recorded measurements and then analyze and tabulate results. This complicated setup procedure requires knowledge and skill, which prohibits an average consumer from self-setup and also may lead to human error. Such a setup procedure also requires expensive equipment further prohibiting the average consumer from self-setup. Alternatively, known methods resort to simple estimations, which may lead to a degraded experience. Additionally, having a precise model of any surfaces in the environment that are reflective to audio waves may benefit more precise beamforming of three-dimensional audio effects.

There is a need for a networked loudspeaker platform that coordinates measurement of an immediate environment of a system of networked loudspeakers to generate locations of reflective surfaces and objects in the environment and create a model of reflective surfaces and objects in the environment.

SUMMARY

A method for creating a model of all of the reflective surfaces in a listening environment that may be applied to a noise cancellation system in a network of loudspeakers in the listening environment. The method is carried out by a processor having a non-transitory storage medium for storing program code, and includes the steps of determining a presence and capability of network loudspeaker participants in a listening environment and establishing a priority of network loudspeaker participants, each network loudspeaker participant has a first microphone array in a first plane and a second microphone array in a second plane that is perpendicular to the first plane and at least one additional sensor measuring a gravity vector direction with respect to at least one array of microphone elements. A coordinator is elected from the network loudspeaker participants based on the priority. At least one network loudspeaker participant at a time to generate a stimulus signal and announce a precise time at which the stimulus signal is generated and each network loudspeaker participant records precise start and end timestamps of the stimulus signal.

Each network loudspeaker participant records precise times of arrival of each echo of the stimulus signal for a predetermined time and each network loudspeaker participant determines an angle of arrival of each echo of the stimulus signal. The angle of arrival is determined in each microphone array plane. The coordinator estimates locations of the network loudspeaker participants within the network and the method is repeated until each network loudspeaker participant has, in turn, generated a stimulus signal and the other network loudspeaker participants have recorded its time of arrival, a time of arrival of each echo and angles of arrival of each echo have been determined.

The coordinator determines co-planarity and estimates orientation of the echoes using the recorded precise times of arrival, determined angles of arrival and the estimated locations of each network loudspeaker participant by grouping reflection points into planar regions based on co-planarity and estimated orientations in order to determine a location of each reflective surface in the listening environment. The result is a model of all of the reflective surfaces in the listening environment that may then be applied to the noise cancellation system.

Elements and steps in the figures are illustrated for simplicity and clarity and have not necessarily been rendered according to any particular sequence. For example, steps that may be performed concurrently or in different order are illustrated in the figures to help to improve understanding of embodiments of the inventive subject matter.

DESCRIPTION OF INVENTION

While various aspects of the inventive subject matter are described with reference to a particular illustrative embodiment, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Figure 1:
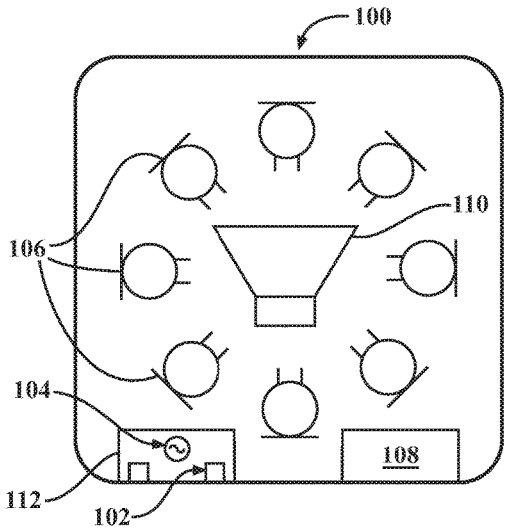
FIG. 1 is a block diagram of an exemplary loudspeaker of one or more embodiments of the inventive subject matter.

A system and method to self-organize a networked loudspeaker platform without human intervention beyond requesting a setup procedure is presented herein. FIG. 1 is a block diagram of an exemplary loudspeaker component, or participant, 100 of one or more embodiments of the inventive subject matter. A loudspeaker component 100 as used in the networked loudspeaker platform is shown in FIG. 1. The loudspeaker component 100 has a network interface 102 having Audio Video Bridging/Time Sensitive Networking (AVB/TSN) capability, an adjustable media clock source 104, a microphone array 106, additional sensors 108, a speaker driver 110 and a processor 112 capable of digital signal processing and control processing. The processor 112 is a computing device that includes computer executable instructions that may be compiled or interpreted from computer programs created using a variety of programming languages and/or technologies. In general, the processor (such as a microprocessor) receives instructions, for example from a memory, a computer-readable medium or the like, and executes the instructions. The processor includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The instructions carried out by the processor 112 include digital signal processing algorithms for generating an audio signal, beamforming of audio recorded from the microphone array 106 and control instructions to synchronize clocks, coordinate measurement procedures, and compile results to provide a common frame of reference and time base for each loudspeaker in the network of loudspeakers. The processor 112 may be a single processor or a combination of separate control and DSP processors depending on system requirements.

The processor 112 has access to the capability, either internally or by way of internal support of a peripheral device, for digital audio output to a digital analog converter (DAC) and an amplifier that feeds the loudspeaker drivers. The digital audio output may be a pulse code modulation (PCM) in which analog audio signals are converted to digital audio signals. The processor has access to the capability, either internally or by way of internal support of a peripheral device, for PCM or pulse density modulation (PDM). The processor 112 has access to the capability, either internally or by way of internal support of a peripheral device, for precise, fine-grained adjustment of a phase locked loop (PLL) that provides a sample clock for the DAC and microphone array interface. Digital PDM microphones may run at a fixed multiple of the sample clock. The processor 110 has access to the capability, either internally or by way of internal support of a peripheral device, for high-resolution timestamp capture capability for medial clock edges. The timestamps may be accurately convertible to gPTP (generalized Precision Timing Protocol) and traceable to the samples clocked in/out at the timestamp clock edge.

The processor 112 has access to the capability, either internally or by way of internal support of a peripheral device, for one or more AVB/TSN-capable network interfaces. One example configuration includes a pair of interfaces integrated with an AVB/TSN-capable three-port switch that allows a daisy-chained set of loudspeaker components. Other examples are a single interface that utilizes a star topology with an external AVB/TSN switch, or use of wireless or other shared media AVB/TSN interfaces.

Capabilities of the AVB/TSN network interface may include precise timestamping of transmitted and received packets in accordance with the gPTP specification and a mechanism by which the integrated timer may be correlated with a high-resolution system timer on the processor such that precise conversions may be performed between any native timer and gPTP grandmaster time.

Figure 2:
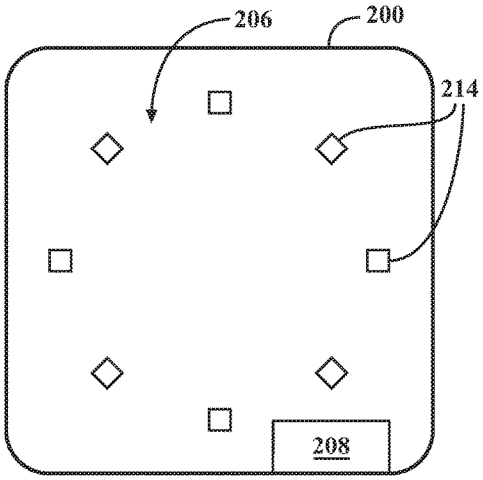
FIG. 2 is a block diagram of the exemplary loudspeaker microphone array.

FIG. 2 is a block diagram of the microphone array for one side of the loudspeaker component 200. Each loudspeaker component 200 has an array 206 of microphone elements 214 arranged in a predetermined geometric pattern, such as a circle as shown in FIG. 2. The predetermined geometric pattern is spread throughout the three-dimensional space such that beamforming algorithms are able to determine a relative heading and elevation of a recorded audio based on measurements such as a time-difference-of-arrival of a sound's wavefront at different microphone elements 214. For example, a configuration for the microphone array may be a set of sixteen total microphone elements 214. A first circle of eight elements 214 is arranged on one side, for example a top side, of the loudspeaker as shown in FIG. 2 and a second circle (not shown in FIG. 2) of eight microphone elements 214 would be located on another side of the loudspeaker, in a plane that is perpendicular to the plane, or top side as in the example shown in FIG. 2, of the first circle of microphone elements 214. It should be noted that the number of microphone elements in the array and the predetermined geometric pattern shown in FIG. 2 are for example purposes only. Variations of the number and pattern of microphone elements in the array of 206 are possible and are too numerous to mention herein. The configuration of geometric patterns and the number of microphone elements in the array may yield heading v. elevation trade-offs.

Sensors 208, in addition to the microphone elements 214, may include sensors that sense air density and distance. Because the propagation rate of sound waves in air varies based on air density, the additional sensors 208 may be included to help estimate an air density of a current environment and thereby improve distance estimations. The additional sensors 208 may be a combination of temperature, humidity, and barometric pressure sensors. It should be noted that the additional sensors 208 are for the purpose of improving distance estimations. The additional sensors 208 may be omitted based on performance requirements as compared to cost of the system.

A minimum number of loudspeaker components 200 in a network will provide measurements from the microphone arrays 206 that are sufficient for determining relative locations and orientations of the loudspeaker components in the network. Specifically, additional sensors 208 that include orientation sensors such as MEMS accelerometers, gyroscopes, and magnetometers (digital compasses) may provide valuable data points in position discovery algorithms.

Figure 3:
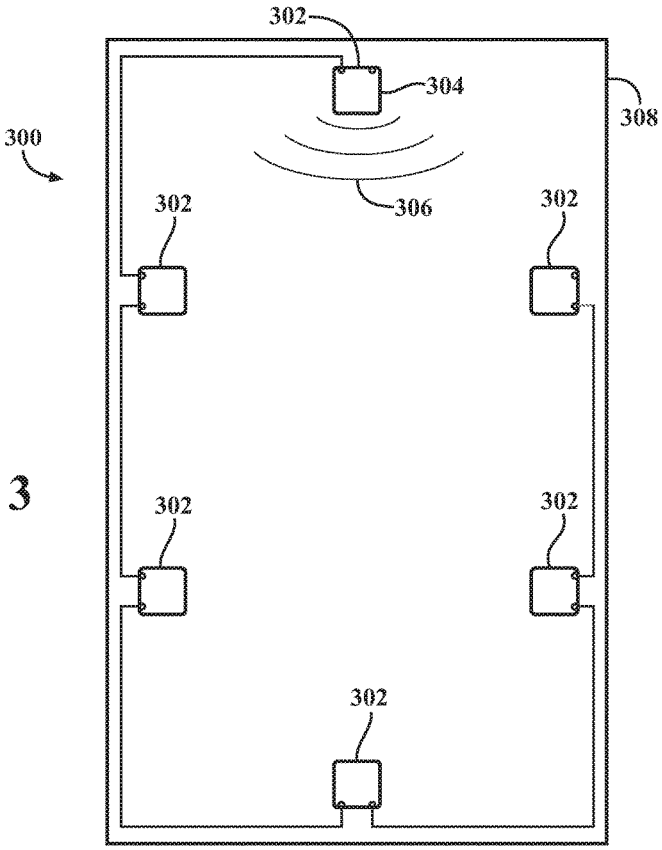
FIG. 3 is a block diagram of an exemplary network of loudspeakers.

FIG. 3 is an example of a network 300 of loudspeaker components 302 arranged around a perimeter of a room 308. One of the loudspeaker components 302 is designated as a coordinator 304. The coordinator 304 initiates a test procedure by directing at least one of the loudspeaker components 302 to generate and play a stimulus 306. The method is described in detail hereinafter.

Figure 4:
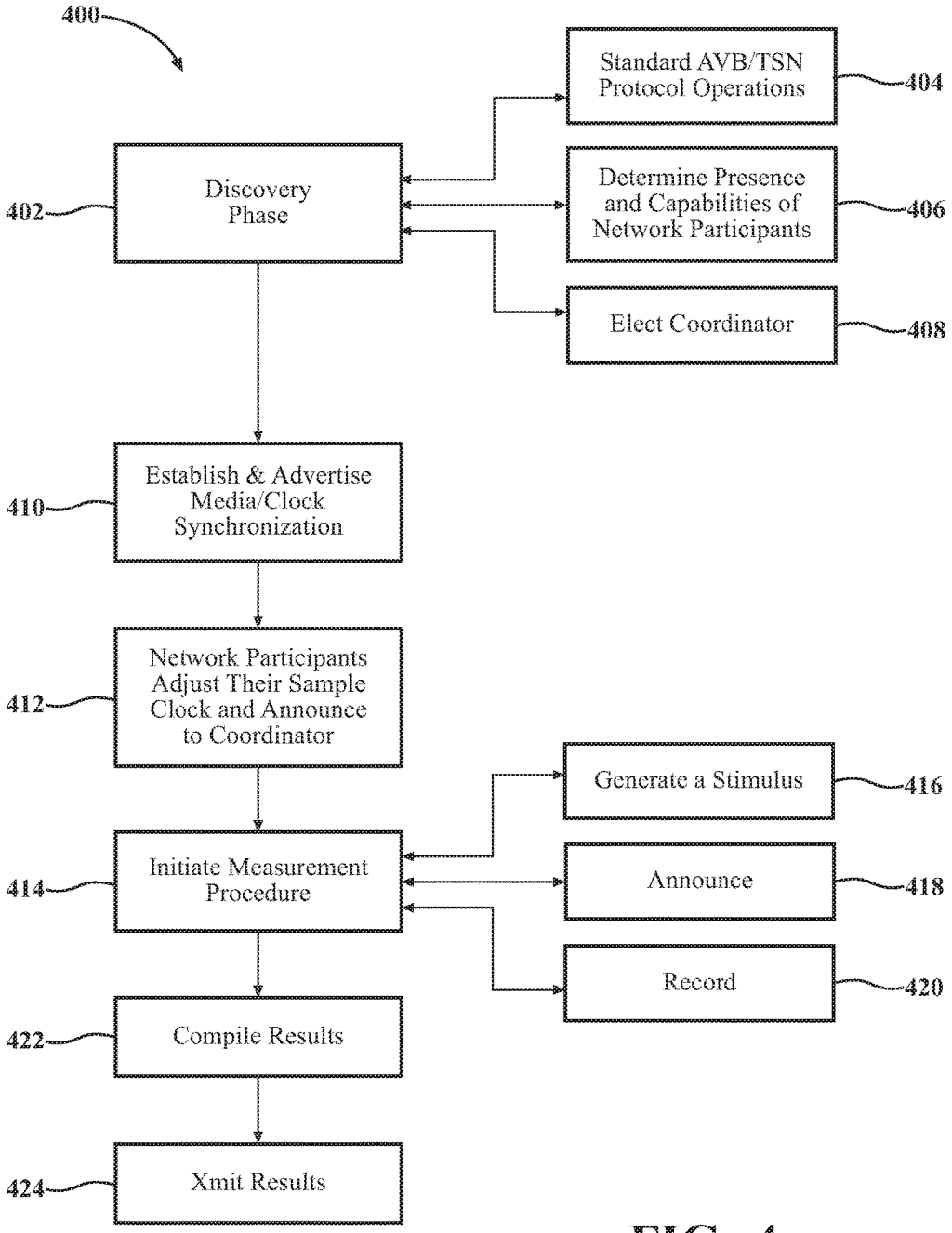
FIG. 4 is a flow chart of a method for measurement and calibration of an exemplary network of loudspeakers.

FIG. 4 is a flow chart of a method 400 for measurement and calibration of a time-synchronized network of loudspeakers with microphone arrays. Referring to FIG. 4, the method 400 begins with a discovery phase 402 that determines network peers and establishes priority. Upon power-up and detection of a network link-up event, the method enters the discovery phase. The discovery phase includes initiating standard AVB/TSN protocol operations 404, such as determining a gPTP grandmaster and Stream Reservation Protocol (SRP) domain attributes. The discovery phase also includes determining the presence and capabilities of other participants 406. (i.e., networked loudspeakers) on the network. Participants may include loudspeakers as described herein, as well as properly equipped personal computers, interactive control panels, etc. as long as they meet the requirements for AVB/TSN participation and are equipped with the computer readable instructions for the method herein.

Electing a single participant as a coordinator of the network 408 is also performed during the discovery phase 402. Election of the coordinator is based on configurable priority levels along with feature-based default priorities. For example, a device with a higher-quality media clock or more processing power may have a higher default priority. Ties in priority may be broken by ordering unique device identifiers such as network MAC addresses. In the event an elected coordinator drops off the network, a new coordinator is elected. The coordinator represents a single point of interface to the loudspeaker network.

Upon election of a coordinator 408, the coordinator establishes and advertises 410 a media clock synchronization stream on the network by way of a stream reservation protocol (SRP). Other participants (i.e., loudspeakers) are aware of the election from the election protocol and actively listen to the stream as they hear the advertisement 410. The other participants receive the sync stream and use it to adjust their own sample clock phase locked loop until it is in both frequency and phase alignment with the coordinators media clock. Once this has occurred, each participant announces their completion of synchronization to the coordinator. Once all of the participants in the network have reported their synchronization to the coordinator, the coordinator announces that the system is ready for use.

Based on a user input, such as from a control surface, a host system or another source, or based on a predetermined situation, such as a first power-on, elapsed runtime, etc., the coordinator initiates 414 a measurement procedure by announcing it to the network loudspeaker participants. One or more of the loudspeaker participants may generate a stimulus 416. The stimulus is an audio signal generated and played by the designated loudspeaker participants. After generation of the stimulus event, the designated loudspeaker participants announce 418 the precise time, translated to gPTP time, at which they generated the stimulus event. A stimulus will generally be generated by one loudspeaker participant at a time, but for some test procedures, the coordinator may direct multiple loudspeaker participants to generate a stimulus at the same time. The participants record 420, with precise start and end timestamps, the sensor data relevant to the test procedure. The timestamps are translated to gPTP time.

Sensor data captured from one measurement procedure 414 may be used as input into further procedures. For example, a measurement procedure 414 may first be initiated to gather data from the sensors associated with environment and orientation. No stimulus is required for this particular measurement procedure 414, but all loudspeaker participants will report information such as their orientation, local temperature, air pressure measurements, etc. Subsequently, each loudspeaker participant in turn may be designated to create a stimulus that consists of a high-frequency sound, a "chirp", after which all other loudspeaker participants will report, to the coordinator, the timestamp at which the first response sample was recorded at each of their microphone elements. The previously gathered environment data may then be used with time difference between each stimulus and response to calculate distance from propagation time, corrected for local air pressure.

As measurement procedures are completed, results are compiled 422, first locally and then communicated to the coordinator. Depending on the measurement procedure that was requested, compilation 422 may occur both at the measurement point and at the coordinator before any reporting occurs. For example, when a loudspeaker participant records the local response to a high-frequency "chirp" stimulus, it may perform analysis of the signals, locally at the loudspeaker participant. Analysis may include beamforming of a first response signal across the microphone array to determine an angle of arrival. Analysis may also include analysis of further responses in the sample stream, indicating echo that may be subject to beamforming. The results of local analysis may be forwarded, in place of or along with, raw sample data depending on the request from the coordinator.

The results may also be compiled by the coordinator. When the coordinator receives reports from other loudspeakers, it may also perform compilation 422. For example, it may combine estimated distances and angles reported from the loudspeaker participants in the system, along with the results from orientation sensors, by way of triangulation or multilateration into a set of three-dimensional coordinates that gives the estimated locations of the loudspeakers in their environment.

Another example of compilation 422 may be for a loudspeaker to simply combine the individual sample streams from its microphone array into a single multi-channel representation before forwarding to the coordinator. The coordinator may then further compile, label, and time-align the samples it receives from each loudspeaker participant before forwarding it to a host. The host will then receive a high channel count set of data as if captures on a single multi-channel recording device.

After compilation 422, the compiled results are transmitted 424. If the measurement procedure was requested by a host system and the host requested to receive the results, the coordinator will conduct the sequence of stimuli and gathering of response data required. After performing any requested compilation, the coordinator will forward the data to the host system that initiated the request and announce the system's readiness to be used for measurement or playback.

The coordinator may also store the results of a measurement procedure, either requested or automatic, for later reporting to a host system if requested so the process does not have to be re-run if the host should forget the results or a different host requests them.

Additionally, or alternatively, the loudspeaker participants may be configured with certain predefined measurement procedures, the compilation procedures of which, result in configuration data about a particular loudspeaker participants and/or the system as a whole. The procedures may be performed automatically or in response to simple user interface elements or host commands. For example, basic measurements as part of a system setup may be triggered by a simple host interface command, such as the touch of a button.

In such a case, once the coordinator has completed the sequence of stimuli and compiled the responses, it may forward the relevant data to all the loudspeaker participants in the network. The loudspeaker participants may each store this data for configuration purposes.

For example, one measurement procedure may result in a set of equalizer (EQ) adjustments and time delay parameters for each loudspeaker participant in the system. The results may form a baseline calibrated playback profile for each loudspeaker participant. Another procedure may result in three-dimensional coordinates for the loudspeaker participant's location. The coordinates may be stored and returned as a result of future queries.

As discussed above, reproducing three-dimensional audio effects requires fairly precise knowledge of relative location and orientation of loudspeaker participants used to reproduce the 3-D effects. Using the networked loudspeaker platform, with time-synchronized networking and microphone arrays, discussed above with reference to FIGS. 1-4, a method for automatically determining precise relative location of loudspeaker participants within a VR/AR room, without manual intervention, is presented herein. The combination of precise time synchronization, microphone arrays with known geometry on the loudspeaker participants, and additional orientation sensors provides adequate data to locate all of the loudspeaker participants in a relative 3-D space upon completion of the method 400. Having the precise room coordinates of the loudspeaker participants enables reproduction of 3-D audio effects and additional measurement accuracy for accomplishments such as real-time position tracking of audio sources.

Referring back to FIG. 3, the networked loudspeaker participants 302 are arranged around the perimeter of the room 308 which has an interior shape that forms a convex polygon. A direct sound propagation path between any pair of loudspeaker participants in the room is needed. While a convex polygon is represented in the present example, other shapes may be possible as long as the loudspeaker participants themselves are arranged in the form of a convex polygon and no barriers, i.e., walls, intrude into the edges of that polygon. Rooms with an unusual geometry may be accommodated by positioning the loudspeaker participants into groups (i.e., two groups) where the condition of having direct sound propagation paths between loudspeakers is met and includes at least one loudspeaker in both groups.

Figure 5:
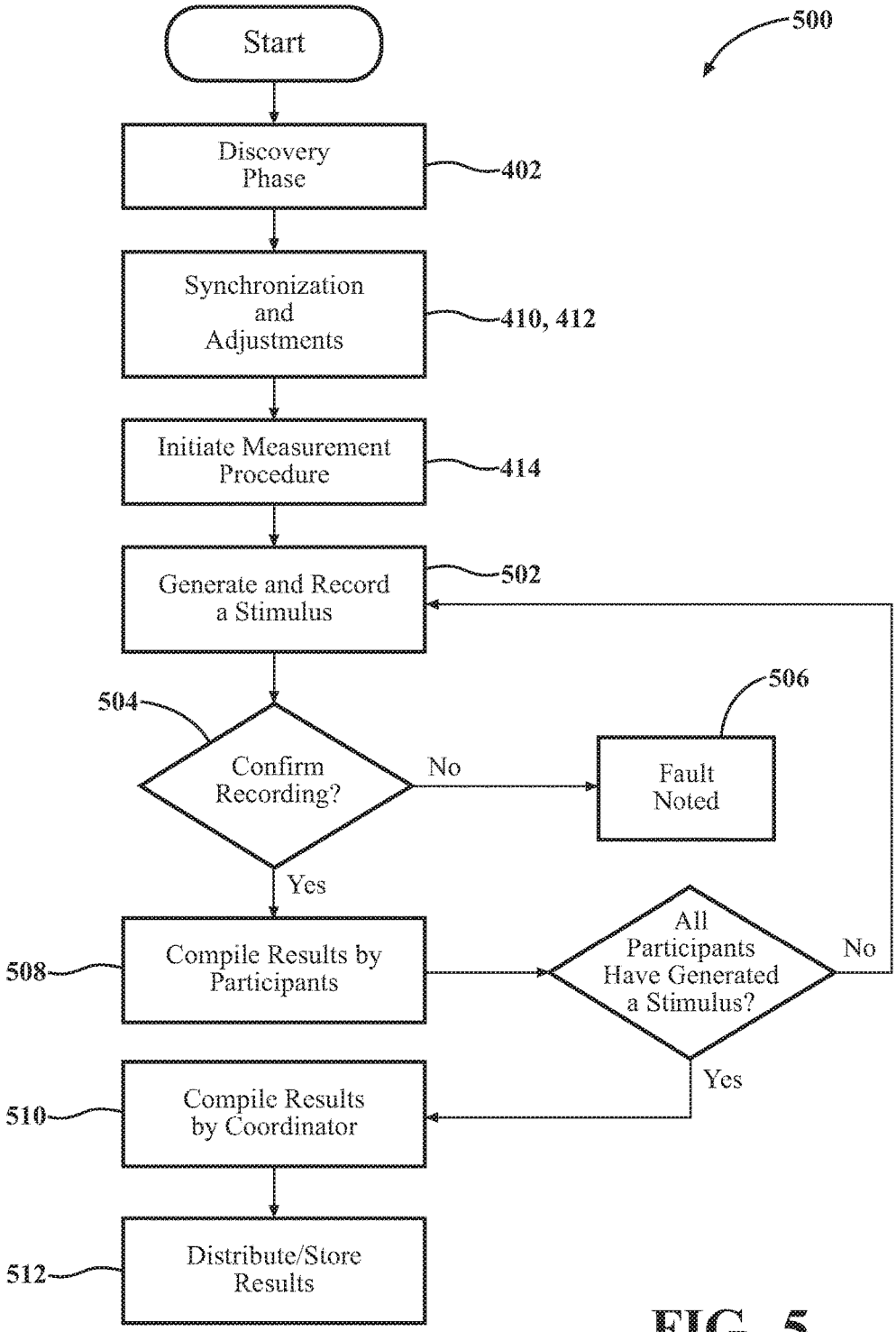
FIG. 5 is a flow chart of a method for automatic speaker placement discovery for an exemplary network of loudspeakers.

Referring now to FIG. 5 a flowchart representing a method 500 for automatic loudspeaker participant discovery is described. A stimulus is generated and recorded 502. Each loudspeaker component, or loudspeaker participant, in the network, in turn, emits a signal, such as an audio signal, that is measured simultaneously by all the loudspeaker participants in the network. An acceptable signal needs to be such that the microphone arrays are sensitive to it and the loudspeakers are capable of producing it. For example, the signal may be in the ultrasonic range. In general, any monochromatic sound pulse at a frequency near an upper end of a range that is resolvable by the system would be acceptable. The precise time of the stimulus signal is provided by the coordinator, and all loudspeaker participants begin recording samples from their microphone arrays at that time. The loudspeaker participant responsible for generating the stimulus also records so that any latency between the instruction to generate the stimulus and the actual sound emission of the stimulus by the loudspeaker participant may be subtracted. The loudspeaker participant responsible for generating the stimulus sends out, to the other loudspeaker participants, the precise timestamp of the first audio sample in which it records the stimulus sound. The other participants in the system continue recording 502 until the stimulus signal has been recorded by all of the microphone elements in the microphone arrays 504. Failure to record a sound is indicative of a system fault 506. Therefore, should a sufficient amount of time pass without a confirmed recording, a system fault may be identified.

The recorded data is compiled by the recording devices 508. Each loudspeaker participant determines the difference between the timestamp of the first recorded sample of the stimulus signal and the timestamp received from the loudspeaker participant the generated the stimulus signal. This difference represents a time in flight, or the time that the stimulus sound wave took to propagate through the air to the recording microphones in loudspeaker participant receiving the stimulus signal. The time in flight value is converted to a distance between transmitter (the loudspeaker participant that generated the stimulus) and receiver (the loudspeaker that received and recorded the stimulus) by multiplying it by a propagation rate of sound in air.

As discussed above with reference to FIG. 2, each loudspeaker participant has its microphone arrays arranged in perpendicular planes. A first microphone array is on a plane which may be parallel to a ceiling and room of a floor. A second microphone array is on a plane perpendicular to the first microphone array. In the event the loudspeaker participant is tilted, corrections may be made to the measurements. For example, a loudspeaker participant with an additional sensor, such as an accelerometer, is capable of measuring a gravity vector direction with respect to the array that is parallel to the ceiling or floor of the room and the second array is known to be perpendicular thereto.

Using a beamforming algorithm, such as a classical delayed sum beamformer, an angle of arrival may be determined in each microphone array plane. This yields 3-D azimuth and elevation measurements relative to a facing direction of the loudspeaker participant. The loudspeaker participants absolute facing is not yet known, but if the loudspeaker participant is equipped with the additional sensor that is a digital compass, that may be used to estimate absolute facing.

Figure 6:
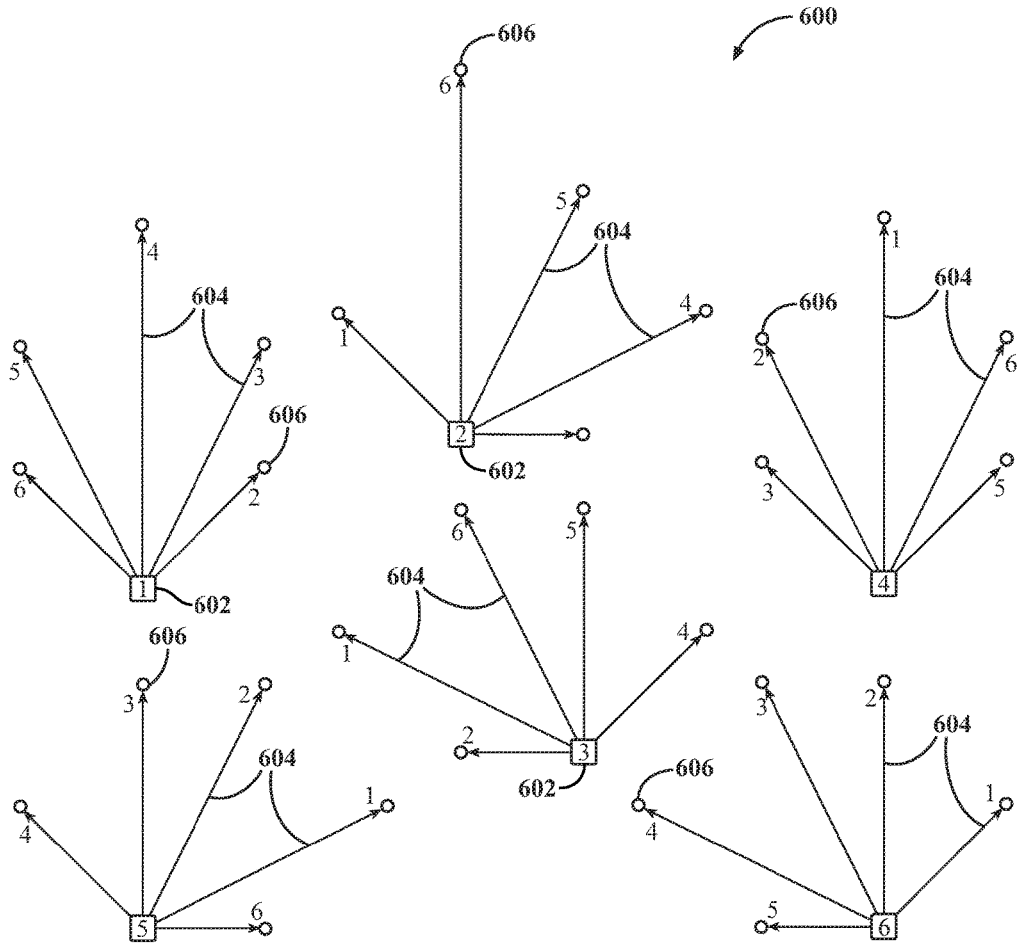
FIG. 6 is a two-dimensional diagram of microphone element position vectors for the exemplary network of loudspeakers.

Each of the microphones in the microphone arrays of the loudspeaker participants has a distance and 3-D direction vector to the stimulus loudspeaker participant, thereby identifying a location in 3-D space centered on each microphone (listening device). See FIG. 6 for diagram that shows a two-dimensional representation 600 of the loudspeaker participants 602 and position vectors 604 that depict the compiled results for each microphone. Each vector 604 is an output of the process described above as it relates to the entire array of microphones at the loudspeaker. Each vector 604(1-5) represents the output of the microphone array for a stimulus event at each other loudspeaker 602(1-6) in the plurality of loudspeakers. For example, speaker 602(1) as a measuring speaker shows vectors 604(2-6) which represent readings of the microphone array on speaker 602(1) as loudspeakers 602(2-6) emit their stimulus.

Referring back to FIG. 5, the position information is transmitted to the coordinator, along with any additional sensor information such as temperature, pressure or orientation sensor data. The coordinator selects the next loudspeaker participant to generate the stimulus signal 502 and the steps 504-508 are repeated until all loudspeaker participants have had a turn generating the stimulus signal and all of the responses have been collected.

The results are compiled 510 by the coordinator. The coordinator now has data for a highly over-constrained geometric system. Each loudspeaker participant in an n-speaker system has n−1 position estimates. However, each estimate's absolute position is affected by an absolute position assigned to the loudspeaker participant that measured it. All of the position estimates need to be brought into a common coordinate system, also referred to as a global coordinate space, in such a way that the measurements captured from each position estimate harmonize with other measurements of the same stimulus. This amounts to an optimization problem where the objective function is to minimize the squared sum of the errors in measured positions v. assigned positions once all participants and measurements have been translated into the common coordinate system. In the algorithm, a greater confidence is assigned to the measured distances than is assigned to measured angles.

The compiled results are stored and distributed 512. Once an optimum set of positions has been compiled, the positions of each loudspeaker in the network are sent, as a group, to all of the participants in the network. Each loudspeaker participant stores its own position in the global coordinate space and translates updated positions from all other participants into its own local frame of reference for ease of use in any local calculations it may be asked to perform.

A management device, such as a personal computer, mobile phone or tablet, in communication with the loudspeaker network may be used to change the global coordinate system to better match a user of the system. For example, a translated set of coordinates may be communicated to the loudspeakers and the loudspeakers only need to update their own position, because the rest are stored relative to that.

A management device that does not know current coordinates for the loudspeaker participants in the network may request the coordinator device provide coordinates in the current coordinate system. The coordinator will request that all loudspeaker participants in the network send their own coordinates, compile them into a list, and return it to the management device.

For more precise beamforming of three-dimensional audio content it is helpful to know not only the location of the loudspeakers, but also the location of any surfaces in the room that are reflective to audio waves. A precise model of the reflective surfaces in the environment may be generated to cancel out reflections for a target listener and provide a better sense of an alternate environment to the listener. FIG. 7 is an example of a loudspeaker and microphone array arrangement used in a method to coordinate measurements of the immediate environment of the system and generate, from the measurements, the locations of reflective objects in the environment.

For simplicity purposes, the listening environment described herein has a standard four walls, a ceiling and a leveled floor, with the ceiling parallel to the floor. The walls are straight and extend perpendicularly, floor to ceiling and adjoin in standard corner configurations. While a typical 6-surface room is modeled herein, it should be noted that the inventive subject matter described herein may be applicable to any room configuration. For example, the listening environment may be a room, which has walls, partial walls, an uneven floor, a tray or pan ceiling, non-standard or irregular corners, doors, windows and may also contain furniture and people. In the example described herein, the listening environment is a six surface room with standard walls, floor and ceiling. The listening environment has loudspeakers, as described above, arranged around borders of the listening environment. Each loudspeaker is equipped with AVB/TSN-capable network interfaces, two planar arrays of microphones arranged in perpendicular planes and knows the relative location of each speaker with respect to the others, such as by using the measurement procedure discussed above with reference to FIGS. 1-6, a method to coordinate measurement of the environment of the system is used to generate, from the measurements, locations of reflective objects in the environment. Instead of analyzing just the first sound wave to arrive as discussed above, a time and angle of arrival of each echo for each loudspeaker is determined and analyzed. Applying geometric analysis, a location of a reflection point for each echo is determined and selected reflection points are combined into a set of possible reflective planes.

Figure 7A:
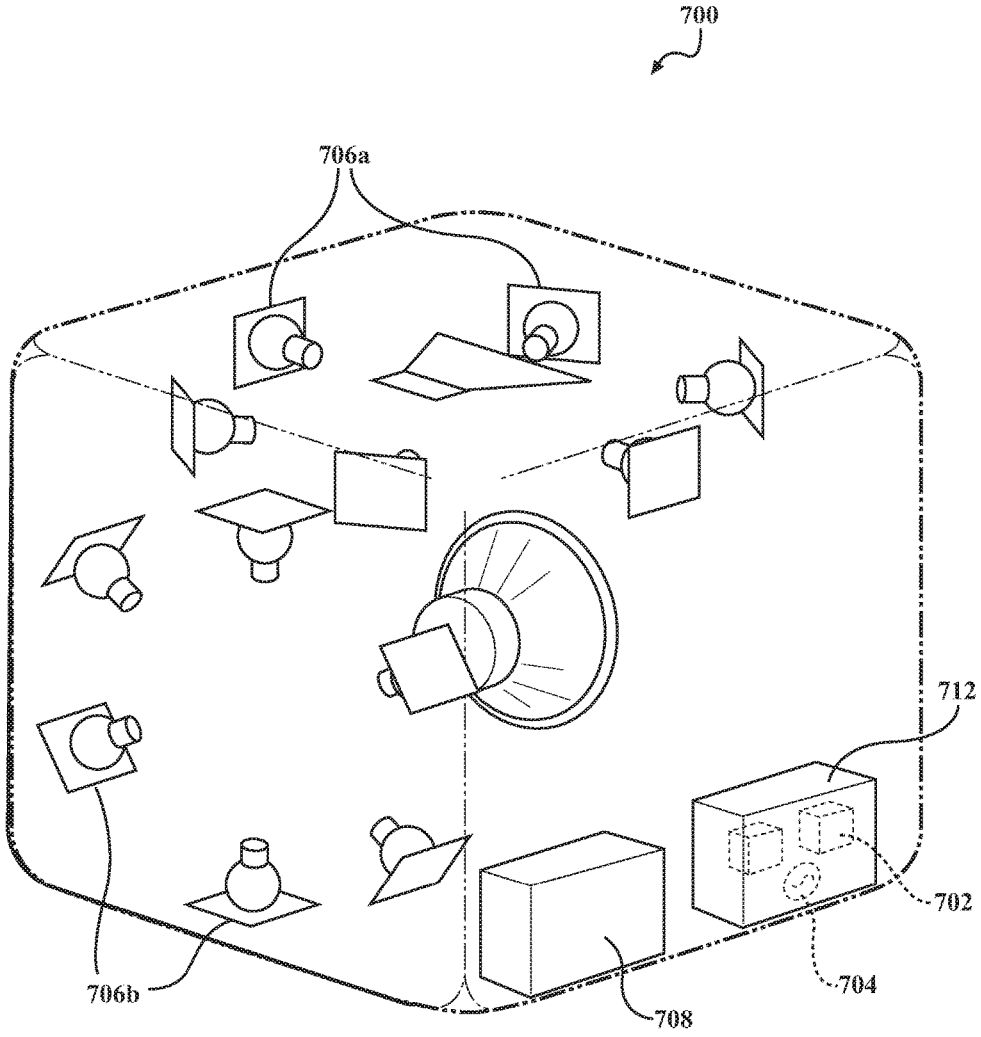
FIG. 7A is a block diagram of a single speaker in the network of speakers.

Each loudspeaker participant 700 is equipped with AVB/TSN-capable network interface 702, two planar arrays of microphones 706*a*, 706*b* arranged in perpendicular planes, a clock 704, additional sensors 708, and a processor 712 is shown in FIG. 7A. The array of microphones 706*a*, 706*b* for each loudspeaker participant is arranged in a predetermined geometric pattern. A circular pattern is shown in FIG. 7A The pattern may be spread through three-dimensional space such that beamforming algorithms may be able to determine the relative heading and elevation of a recorded sound based on measurements such as the time-difference-of-arrival of a sound's wave front at different microphone elements. Because the propagation rate of sound waves in air varies based on air density, the additional sensors 708 may be included to help estimate a current air density in the environment which may improve distance estimations. The additional sensors 708 may include, but are not limited to, any one or more of temperature, humidity, and barometric pressure sensors. The loudspeakers may be arranged around the borders of the environment so that they are spread fairly evenly about an area that a target listener may occupy. Synchronization and election procedures have been performed and a relative location for each loudspeaker are known.

Figure 7B:
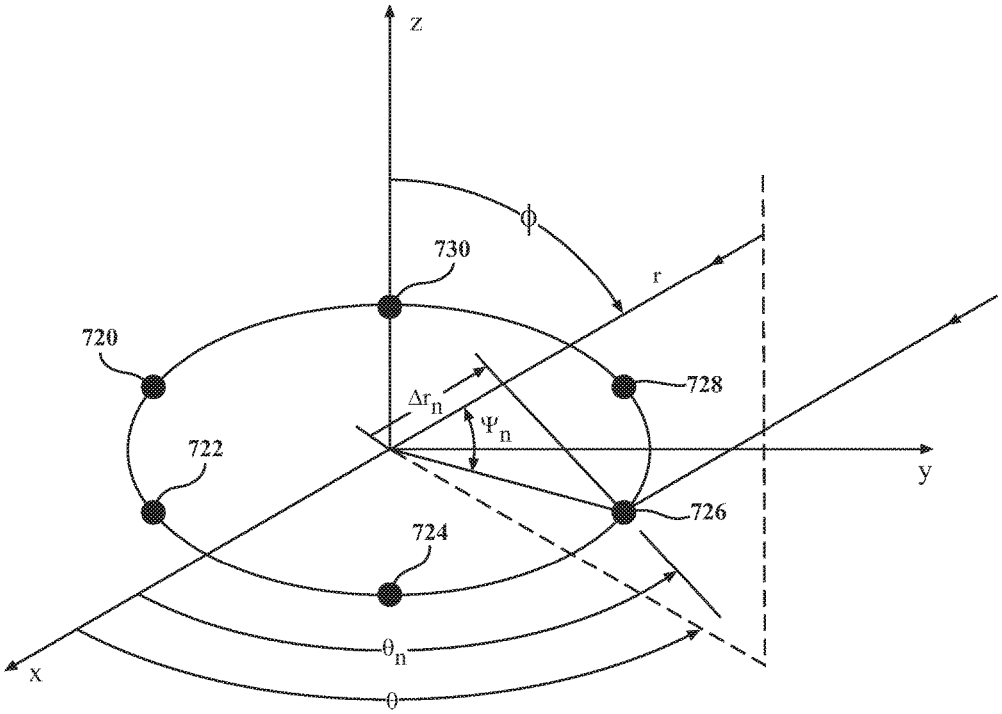
FIG. 7B is an example of a circular microphone array showing a plane wave incident on the array.

FIG. 7B is a depiction of the geometry associated with a planar wave arriving at a center of a circular microphone array 706*a*. Microphones 720-730 are radially positioned about the center and a projection of a radial component, r, shows the incoming wave. In practice, there are at least two microphone arrays positioned perpendicular to each other for each loudspeaker participant and the location of each loudspeaker participant is known relative to the other loudspeaker participants in the networked system.

Figure 8A:
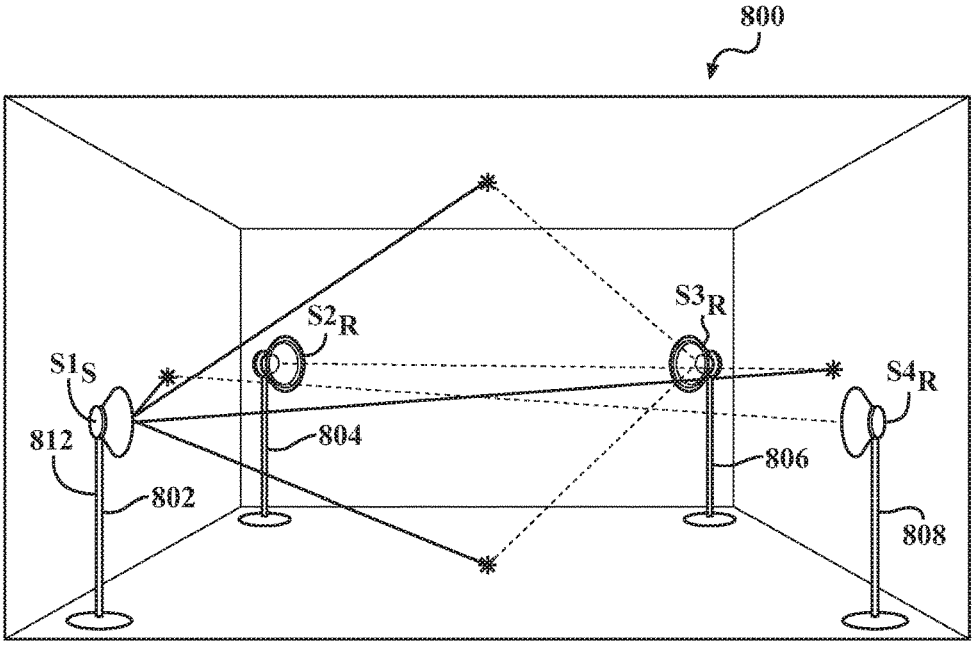
FIGS. 8A-8D are representations of sound waves for one or more stimulus source signals and echo paths and grouping reflection points into planar regions as each loudspeaker takes a turn emitting a stimulus.
Figure 8B:
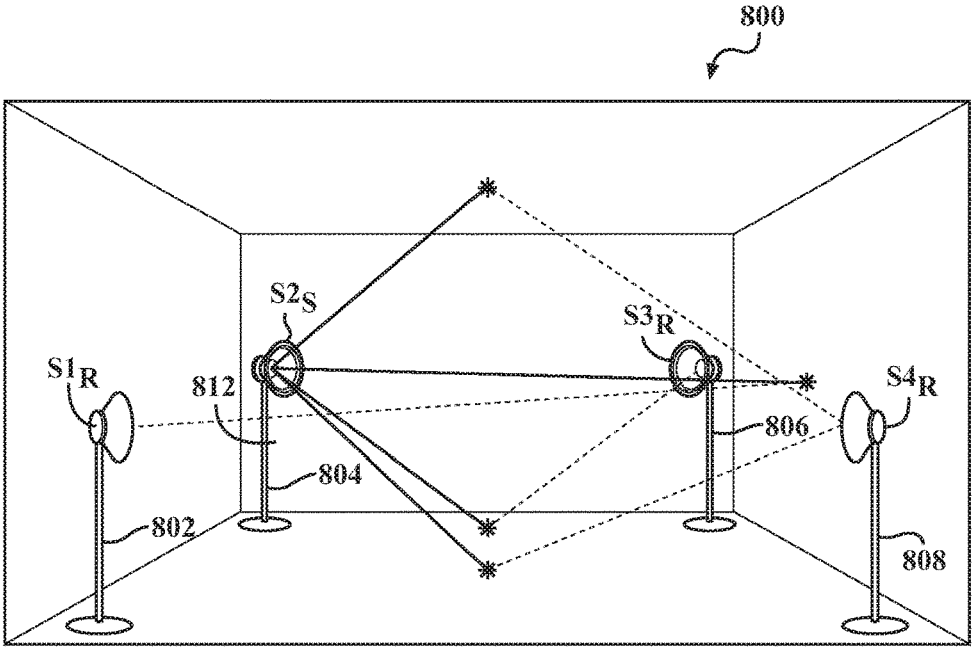
Figure 8C:
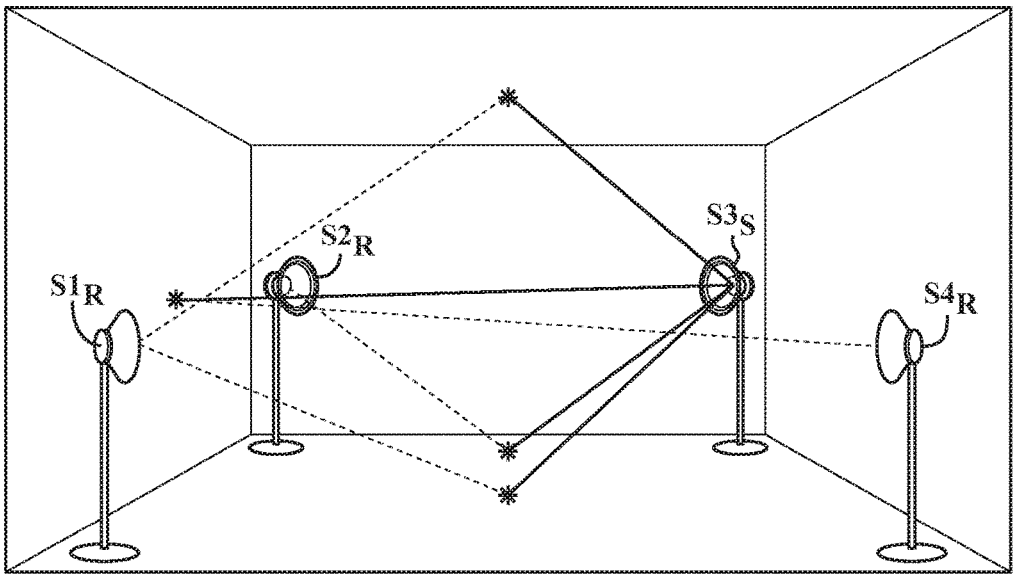
Figure 8D:
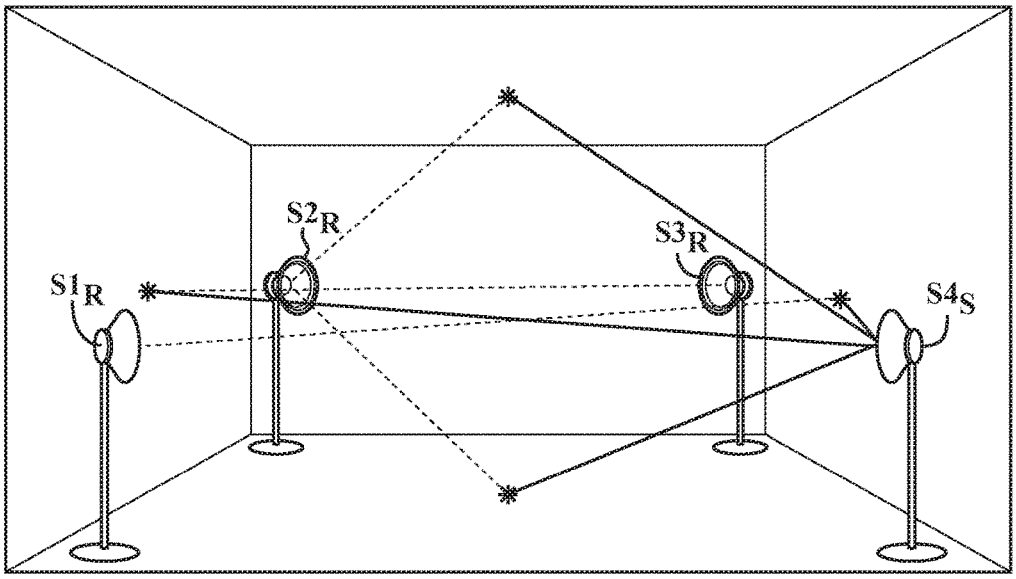

For clarity and simplicity, the stimulus and echo paths are shown as a single line to and from each loudspeaker participant and reflective surfaces. Referring to FIGS. 8A-8D, examples of the loudspeaker arrangement in the environment is shown depicting geometric information about echo paths (shown in dashed lines) that a sound wave (shown in solid line) travelled from a first loudspeaker 802 acting as a stimulus source $S1_s$ to each of the other loudspeakers 806, 808, 810 including the source 802. One of the loudspeakers 802 in the plurality of loudspeakers 802, 804, 806, 808 has been designated a coordinator 812, as discussed with reference to FIGS. 3 and 4. Each loudspeaker 802, 804, 806, 808 will take a turn emitting a stimulus source. This is shown in FIG. 8A, where loudspeaker 802 is the source S1*s*. In FIG. 8B, loudspeaker 804 is the source $S2_s$. Loudspeaker 806 is the source $S3_s$ in FIG. 8C and loudspeaker 808 is the source S4, in FIG. 8D.

Figure 9A:
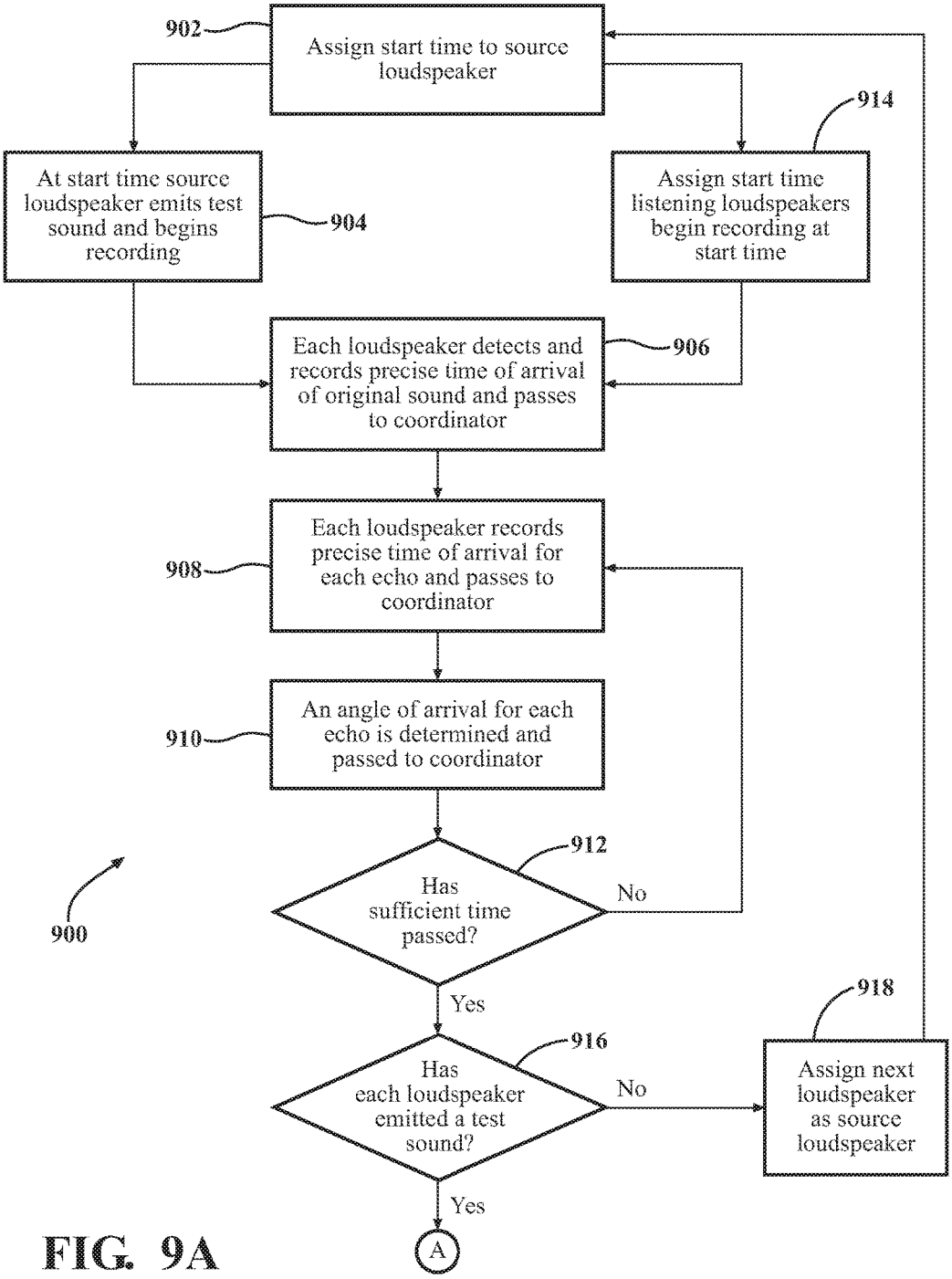
FIGS. 9A and 9B are flowcharts of a method for modelling any surfaces in a listening environment that are reflective to audio waves and applying the model to create precise beamforming of three-dimensional audio effects.
Figure 9B:
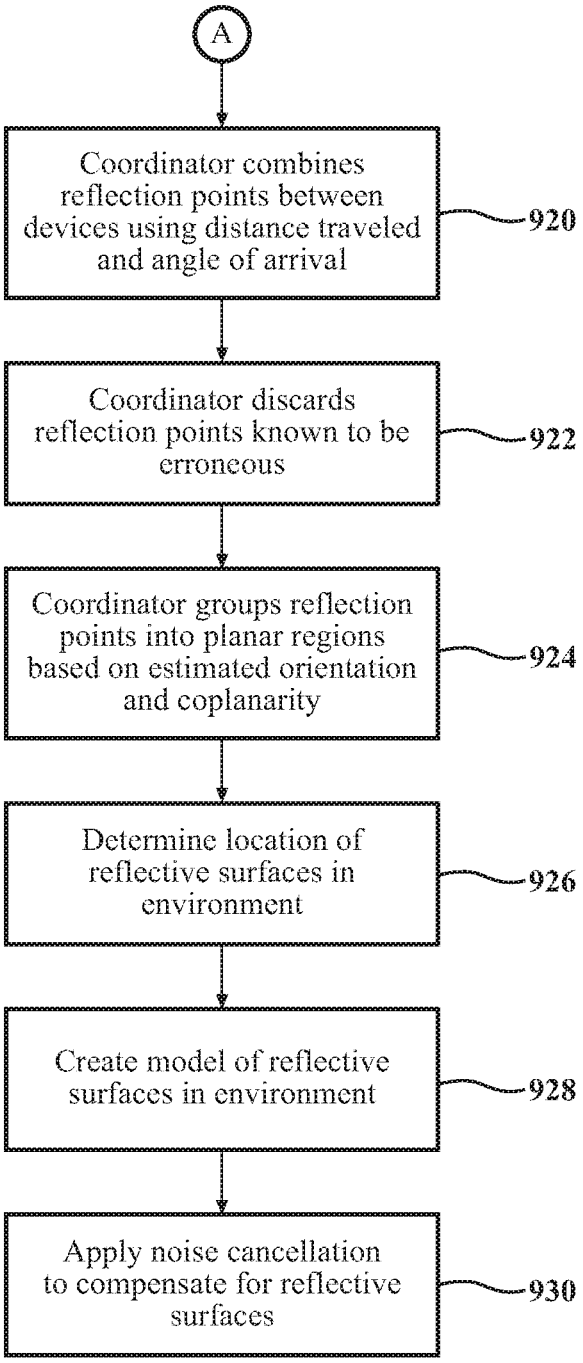

The coordinator 812 is responsible for assigning start times, designating a loudspeaker to emit its stimulus source, receive all of the recorded precise times associated with the stimulus sources arriving at each microphone array in each loudspeaker and the echo paths associated with each loudspeaker, as well as combining reflection points to model the location of reflective surfaces in the environment and applying noise cancellation to compensate for the reflective surfaces, described hereinafter in more detail with reference to FIGS. 9A and 9B.

Referring now to FIG. 9A, a method 900 for a measurement procedure is shown, and begins by the coordinator assigning 902 a start time to a first loudspeaker to be designated as a source and whose relative location is known to all other loudspeakers in the listening environment. The designated source loudspeaker is emitting 904 a stimulus, or test sound, and all other loudspeakers in the environment are listening to initially detect the stimulus and any echoes of the stimulus. When the start time arrives, the source loudspeaker emits 904 the stimulus. The original wave arrival of the stimulus is detected and a precise time at which it detects the original wave arrival of the stimulus is recorded 906. The step of recording a precise time continues 908 for arrival of each echo that returns to the source loudspeaker. For each echo that returns to the source loudspeaker, an angle at which the echo arrived is also determined 910.

The determination of an angle of arrival may be accomplished by performing a beamforming operation on each echo. Recording 908, 910 continues for a predetermined amount of time or until a point in time at which echoes have ceased 912. The amount of time recording takes place may be made based on a time deemed to be sufficient, or a predetermined amount of time has passed, to account for an approximate size of the environment.

Also occurring at the assigned start time, each of the loudspeakers in the environment begin listening and recording 914. Each of the listening loudspeakers detects and records 906 a precise time of the first arrival of the stimulus emitted by the source loudspeaker and a precise time of arrival for each echo 908. A determination of an angle at which each echo has arrived 910 at each of the listening loudspeakers is also made. Again, this determination may be accomplished by performing a beamforming operation on each echo. The listening loudspeakers in the environment also continue recording 908 and determining an angle of arrival 910 for each echo for a sufficient, or predetermined, amount of time 912 that should account for an approximate size of the environment.

The method steps 902-914 are repeated 916 until each loudspeaker has been assigned, by the coordinator, its turn as the source loudspeaker emitting 904 a stimulus. Referring now to FIG. 9B, the method continues with each of the loudspeaker devices forwarding their timestamps of the original wave arrival of the stimulus and each of the echoes, along with the three-dimensional angle of arrival (determined such as through beamforming arrays for each echo), to be combined 920 by the coordinator. The coordinator combines 920 the geometric knowledge of the known relative locations of each of the loudspeakers with the newly gathered geometric information representative of the reflective surfaces in the listening environment. The coordinator already has geometric knowledge of the relative locations of the loudspeakers. This knowledge may be combined with the collected geometric information about the echo paths that each stimulus took from its source loudspeaker to each of the loudspeakers (including the source) in the environment. During this process, some reflection points may need to be discarded 922. For example, certain reflection points may be the result of higher-order reflections, or other erroneous echo recognition events. Such reflection points should be excluded from the combination.

A difference between the time recorded when the source loudspeaker hears its initial stimulus to the time recorded when each listening loudspeaker hears one or more echoes represents a distance traveled. For a single reflection between two loudspeakers, the geometry of the echo forms a triangle, such that the location of the reflective surface may be determined by the distance and the angle of arrival. Two of the other points of the triangle are already known (the location of the source and the location of the listening loudspeaker relative to the source). The angle of arrival for each echo helps determine whether the reflective surface is a horizontal surface or a vertical surface and are representative of reflection points.

The coordinator takes all the remaining reflection points and groups them 924 into planar regions based on an estimated orientation and co-planarity. The groupings determine 926 a location of any reflective surfaces in the environment 926. From this determination, a model of the reflective surfaces within the environment is created 928. The model provides knowledge of the location of the loudspeakers and the location of any reflective surfaces in the environment provide more precise beamforming of three-dimensional audio content 930 wherein sound may be generated to cancel out reflections for a target listener and provide a better sense of an alternate environment for the target listener.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Measurements may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

The invention claimed is:

1. A method carried out by a processor having a non-transitory storage medium for storing program code, the method comprising the steps of:

a. designating one loudspeaker component in a listening environment having a network of Audio-Video Bridging/Time Synchronized Network (AVB/TSN) loudspeaker components to be a coordinator, each loudspeaker component has a first array of microphones on a first plane and at least a second array of microphones on a second plane perpendicular to the first plane, a location of each loudspeaker component in the listening environment is known to each of the other loudspeaker components;

b. the coordinator assigning a start time to one of the loudspeaker components in the network of AVB/TSN loudspeaker components;

c. the one loudspeaker component emitting a stimulus at the assigned start time, the stimulus having a plurality of echos;

d. recording, at each loudspeaker component, a precise time of arrival of the stimulus;

e. passing the precise time of arrival of the stimulus recorded at each loudspeaker component to the coordinator;

f. determining, at each loudspeaker component, an angle of arrival of the stimulus;

g. passing the angle of arrival of the stimulus determined at each loudspeaker component to the coordinator;

h. recording, at each loudspeaker component, a precise time of arrival for each echo of the stimulus;

i. passing the precise time of arrival of each echo of the stimulus recorded at each loudspeaker component to the coordinator;

j. determining, at each loudspeaker component, an angle of arrival of each echo of the stimulus;

k. passing the angle of arrival of each echo determined at each loudspeaker component to the coordinator;

l. continuing the steps of recording a precise time of arrival for each echo of the stimulus and determining an angle of arrival for each echo of the stimulus for a predetermined amount of time that allows each echo's precise time of arrival to be recorded and passed to the coordinator and each echo's angle of arrival to be determined and passed to the coordinator;

m. repeating the steps (a)-(l) until each loudspeaker in the network of AVB/TSN loudspeakers has emitted a stimulus and all of the recorded precise times of arrival and determined angles of arrival have been passed to the coordinator;

n. determining, at the coordinator, co-planarity and estimating orientation of the echoes using the recorded precise time of arrival, determined angles of arrival and the known locations of each loudspeaker component by;

o. grouping, at the coordinator, reflection points into planar regions based on co-planarity and estimated orientations to determine a location of each reflective surface in the listening environment; and p. creating, at the coordinator, a model of all of the reflective surfaces in the listening environment.

2. The method as claimed in claim 1 wherein the step of grouping reflection points further comprises the step of eliminating reflection points that are known to be erroneous.

3. The method as claimed in claim 1 further comprising the step of applying the model of all of the reflective surfaces in the listening environment to a noise cancellation system in the network of AVB/TSN loudspeakers.

4. The method as claimed in claim 1 wherein the step of continuing the steps of recording a precise time of arrival for each echo of the stimulus and determining an angle of arrival for each echo of the stimulus for a predetermined amount of time further comprises a predetermined amount of time that lasts until all echoes have ceased.

5. The method as claimed in claim 1 wherein the step of continuing the steps of recording a precise time of arrival for each echo of the stimulus and determining an angle of arrival for each echo of the stimulus for a predetermined amount of time further comprises a predetermined amount of time that accounts for a size of the listening environment.

6. The method as claimed in claim 1 wherein the network of AVB/TSN loudspeaker components further comprises additional sensors capable of collecting data representative of temperature, humidity, and barometric pressure of the listening environment, and orientation of each loudspeaker component within the listening environment and wherein the steps of recording precise times of arrival and determining angles of arrival further comprises using data from the additional sensors.

7. A method carried out by a processor having a non-transitory storage medium for storing program code, the method comprising the steps of:

determining a presence and capability of network loudspeaker participants in a listening environment and establishing a priority of network loudspeaker participants, each network loudspeaker participant has a first microphone array in a first plane and a second microphone array in a second plane that is perpendicular to the first plane and at least one additional sensor measuring a gravity vector direction with respect to at least one array of microphone elements;

electing, a coordinator from the network loudspeaker participants based on the priority the coordinator establishing and advertising a media clock stream;

receiving the media clock stream at each network loudspeaker participant and each network loudspeaker participant synchronizing to the clock stream received from the coordinator and announcing synchronization to the coordinator;

designating at least one network loudspeaker participant, in succession, to generate a stimulus signal and announce a precise time at which the stimulus signal is generated;

each network loudspeaker participant recording precise start and end timestamps of the stimulus signal and environmental data collected as results;

each network loudspeaker participant recording precise times of arrival of each echo of the stimulus signal for a predetermined time;

each network loudspeaker participant determining an angle of arrival of each angle of arrival of each echo of the stimulus signal in each microphone array plane for the predetermined time;

transmitting the results to the elected coordinator;

repeating the steps of receiving, designating, recording, determining, and transmitting until each of the network loudspeaker participants has, in turn, generated a stimulus signal and the predetermined amount of time has passed;

estimating locations of the network loudspeaker participants within the network;

determining, at the coordinator co-planarity and estimating orientation of the echoes using the recorded precise time of arrival, determined angles of arrival and the estimated locations of each network loudspeaker participant by;

grouping, at the coordinator, reflection points into planar regions based on co-planarity and estimated orientations to determine a location of each reflective surface in the listening environment; and creating, at the coordinator, a model of all of the reflective surfaces in the listening environment.

8. The method as claimed in claim 7 wherein the step of grouping reflection points further comprises eliminating reflection points that are known to be erroneous.

9. The method as claimed in claim 7 wherein the predetermined time further comprises a predetermined time that lasts until all echoes have ceased.

10. The method as claimed in claim 7 wherein the predetermined time further comprises a predetermined time that accounts for a size of the listening environment.

11. The method as claimed claim 7 wherein the network further comprises a noise cancellation system and the method further comprises the step of applying the model of all of the reflective surfaces in the listening environment to the noise cancellation system.

12. The method as claimed in claim 7 wherein the environmental data further comprises environmental data collected from sensors in the system selected from the group consisting of temperature sensors, humidity sensors, barometric pressure sensors, Micro-electro-mechanical-system (MEMS) accelerometers, gyroscopes, and magnetometers, and the steps of recording precise times of arrival and determining angles of arrival further comprises using other environmental data.

* * * * *